US007552722B1

(12) United States Patent
Shieh et al.

(10) Patent No.: US 7,552,722 B1
(45) Date of Patent: Jun. 30, 2009

(54) EXHAUST GAS RECIRCULATOR DEVICES

(75) Inventors: Teng-Hua Shieh, Ann Arbor, MI (US); Naveen Rajan, Ann Arbor, MI (US); Manoj Sampath, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 11/964,306

(22) Filed: Dec. 26, 2007

(51) Int. Cl.
*F02B 47/08* (2006.01)

(52) U.S. Cl. ..... 123/568.17; 60/602

(58) Field of Classification Search ..... 123/568.15, 123/568.17, 568.18, 568.19, 568.11, 590; 60/605.2, 278, 280, 602
See application file for complete search history.

(56) References Cited

U.S. PATENT DOCUMENTS

| | | | | |
|---|---|---|---|---|
| 1,432,751 | A | 10/1922 | Hallett | |
| 2,354,179 | A | 7/1944 | Blanc | |
| 4,393,853 | A | 7/1983 | Groves | |
| 4,461,150 | A | 7/1984 | Grohn | |
| 6,089,019 | A | 7/2000 | Roby et al. | |
| 6,267,106 | B1 * | 7/2001 | Feucht | 123/568.17 |
| 6,343,594 | B1 | 2/2002 | Koeslin et al. | |
| 6,425,382 | B1 * | 7/2002 | Marthaler et al. | 123/568.17 |
| 6,427,671 | B1 | 8/2002 | Holze et al. | |
| 6,439,212 | B1 * | 8/2002 | Coleman et al. | 123/568.17 |
| 6,494,041 | B1 | 12/2002 | Lebold | |
| 6,609,373 | B2 * | 8/2003 | Coleman et al. | 60/602 |
| 6,609,374 | B2 | 8/2003 | Feucht et al. | |
| 6,640,542 | B2 * | 11/2003 | Coleman et al. | 60/605.2 |
| 6,659,092 | B2 * | 12/2003 | Coleman et al. | 123/568.17 |
| 6,748,741 | B2 * | 6/2004 | Martin et al. | 60/605.2 |
| 6,880,535 | B2 * | 4/2005 | Sorter et al. | 123/528 |
| 6,945,237 | B1 | 9/2005 | Sullivan et al. | |
| 7,028,680 | B2 | 4/2006 | Liu et al. | |
| 7,032,578 | B2 | 4/2006 | Liu et al. | |
| 7,104,042 | B2 | 9/2006 | Pagot | |
| 7,140,357 | B2 * | 11/2006 | Wei et al. | 123/568.17 |
| 7,243,641 | B2 * | 7/2007 | Zukouski | 123/568.17 |
| 7,281,530 | B2 * | 10/2007 | Usui | 123/568.17 |
| 7,389,770 | B2 * | 6/2008 | Bertilsson et al. | 123/568.17 |
| 2003/0111065 | A1 * | 6/2003 | Blum | 123/568.17 |
| 2003/0226552 | A1 * | 12/2003 | Hewkin | 123/568.11 |

(Continued)

FOREIGN PATENT DOCUMENTS

| | | |
|---|---|---|
| JP | 63117124 | 5/1988 |

(Continued)

*Primary Examiner*—Michael Cuff
*Assistant Examiner*—Hung Q Nguyen
(74) *Attorney, Agent, or Firm*—Dinsmore & Shohl LLP

(57) ABSTRACT

Embodiments of an exhaust gas recirculation (EGR) device comprise a mixing pipe having an air inlet port and an outlet port disposed at opposite ends of the mixing pipe, and an exhaust inlet port disposed at a region of the mixing pipe between the air inlet port and the outlet port, wherein the exhaust inlet port is configured to deliver exhaust to be mixed with air inside the mixing pipe. The exhaust gas recirculation (EGR) device further comprises a nozzle disposed internally within a region of the mixing pipe between the exhaust inlet ring and the outlet port such that the diffuser nozzle defines an outer mixing channel in the spacing between the diffuser nozzle and the mixing pipe region.

19 Claims, 10 Drawing Sheets

U.S. PATENT DOCUMENTS

| | | | | |
|---|---|---|---|---|
| 2005/0086936 | A1 | 4/2005 | Bucknell et al. | |
| 2007/0119433 | A1 * | 5/2007 | Popik et al. | 123/568.17 |
| 2007/0130948 | A1 | 6/2007 | Boehm et al. | |

FOREIGN PATENT DOCUMENTS

| | | |
|---|---|---|
| JP | 1195923 | 8/1989 |
| JP | 4295133 | 10/1992 |

* cited by examiner

EXHAUST GAS RECIRCULATOR DEVICES

TECHNICAL FIELD

Embodiments of the present invention are generally directed to exhaust gas recirculation and are specifically directed to exhaust gas recirculation devices including mixing pipes and components associated therewith.

BACKGROUND

Exhaust gas recirculation (EGR) devices are well known in the automotive industry. EGR devices are systems that mix combustion exhaust with air prior to feeding into the intake manifold of an internal combustion engine. Mixing exhaust gas generally increases the specific heat capacity of the air/exhaust mixture, thereby lowering the peak combustion temperature. Lowering the combustion temperature limits the generation of NOx, which is prevalent when nitrogen and oxygen are subjected to high temperatures inside an engine. As a result, there is a continuing demand for improved EGR devices, which reduce combustion temperatures and NOx emissions, and improve overall engine performance.

SUMMARY

According to one embodiment, an exhaust gas recirculation (EGR) device includes a mixing pipe having an air inlet port disposed at one end of the mixing pipe, an outlet port disposed at an opposite end of the mixing pipe, an exhaust inlet port disposed at a region of the mixing pipe between the air inlet port and the outlet port, wherein the exhaust inlet port is configured to deliver exhaust to be mixed with air inside the mixing pipe and a diffuser nozzle comprising an outwardly tapering cross section disposed coaxially within a region of the mixing pipe between the exhaust inlet port and the outlet port, wherein the EGR mixing pipe comprises an outer mixing channel in the spacing between the diffuser nozzle and the mixing pipe and a central mixing channel extending through at least a portion of the diffuser nozzle.

According to another embodiment of An exhaust gas recirculation (EGR) device includes a mixing pipe having an air inlet port disposed at one end of the mixing pipe, an outlet port disposed at an opposite end of the mixing pipe, an exhaust inlet ring disposed coaxially around the mixing pipe at a region between the air inlet port and the outlet port, the exhaust inlet ring being comprised of a plurality of radial openings extending through the inlet ring, wherein the exhaust inlet ring is configured to deliver exhaust to be mixed with air inside the mixing pipe via the plurality of radial openings and a diffuser nozzle disposed internally within a region of the mixing pipe between the exhaust inlet ring and the outlet port.

In yet another embodiment, an exhaust gas recirculation (EGR) device includes a mixing pipe having an air inlet port disposed at one end of the mixing pipe, an outlet port disposed at an opposite end of the mixing pipe, an exhaust inlet ring disposed coaxially around the mixing pipe at a region between the air inlet port and the outlet port and a diffuser nozzle disposed coaxially within a region of the mixing pipe between the exhaust inlet port and the outlet port, wherein the mixing pipe region coaxially surrounding the diffuser nozzle defines an outwardly tapering cross section, wherein the EGR mixing pipe comprises an outer mixing channel in the spacing between the diffuser nozzle and mixing pipe region, and a central mixing channel extending through the diffuser nozzle.

These and additional features provided by the embodiments of the present invention will be more fully understood in view of the following detailed description, in conjunction with the drawings.

BRIEF DESCRIPTION OF THE DRAWINGS

The following detailed description of specific embodiments of the present invention can be best understood when read in conjunction with the drawing enclosed herewith.

Figure 1A:
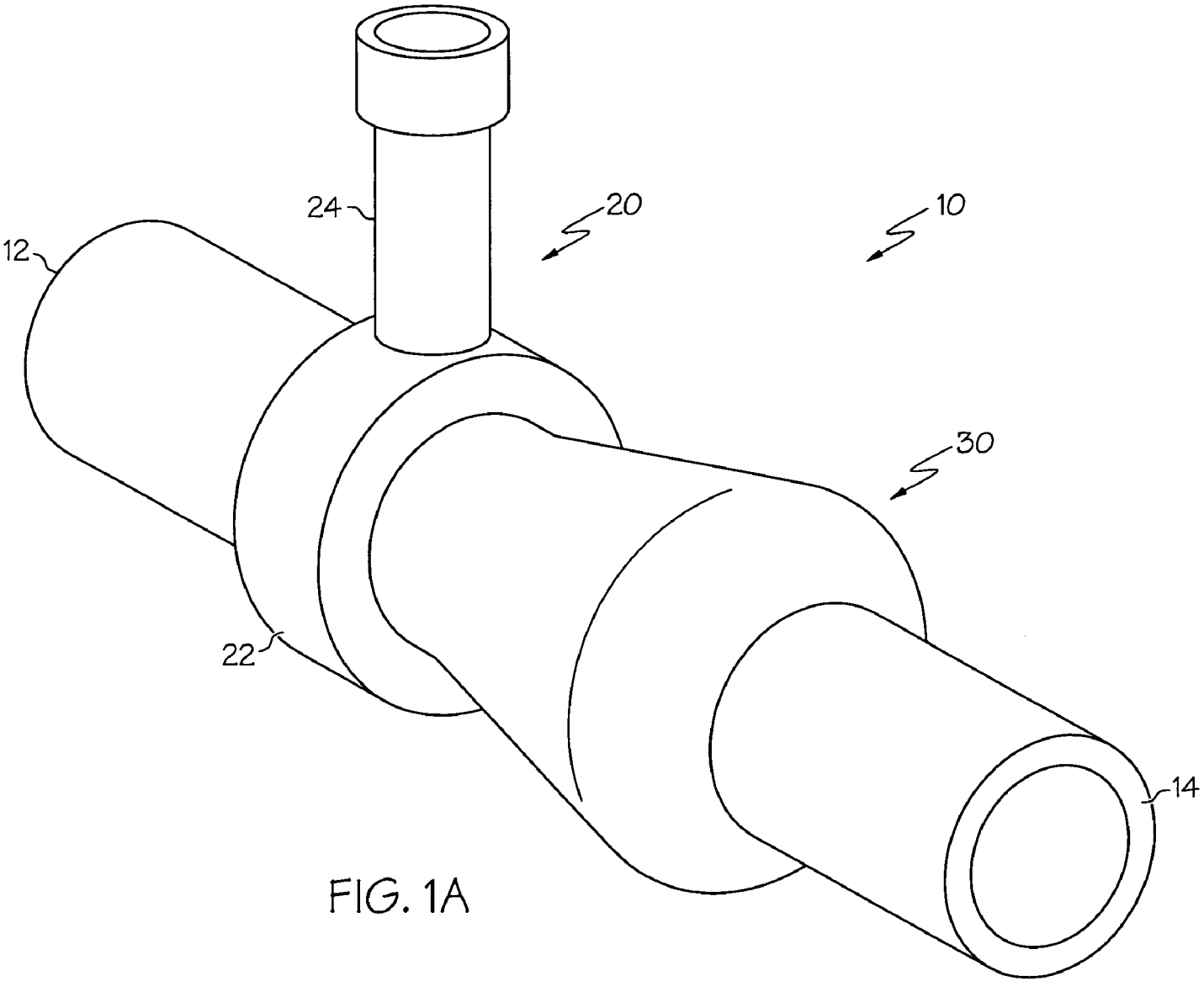
FIG. 1A is a perspective view of an EGR mixing pipe according to one or more embodiments of the present invention.

The embodiments set forth in the drawing are illustrative in nature and not intended to be limiting of the invention defined by the claims. Moreover, individual features of the drawings and invention will be more fully apparent and understood in view of the detailed description.

DETAILED DESCRIPTION

The present invention is directed to improved EGR mixing pipes, which facilitate better mixing of the air and exhaust (e.g. combustion exhaust from an internal combustion engine) prior to entry into the intake manifold. To improve the mixing, the embodiments of the present invention may utilize an exhaust ring comprising a plurality of openings configured to introduce exhaust in a more uniform manner. To further improve the mixing of air and exhaust prior to entry into the intake manifold, the mixing pipe may also utilize outwardly tapering nozzles (e.g., diffuser nozzles) disposed within the mixing pipe and configured to increase the residence time within the mixing pipe.

Figure 1B:
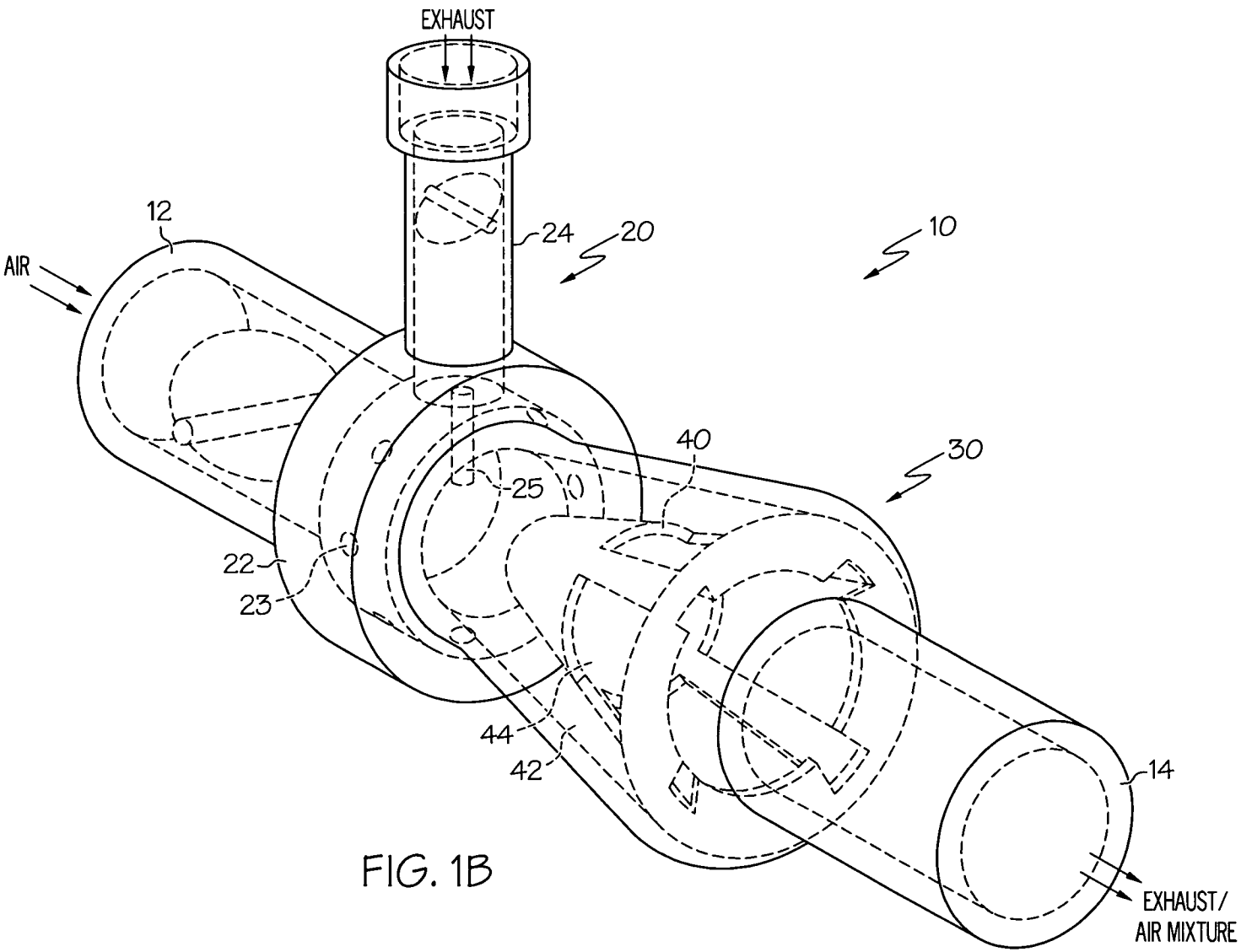
FIG. 1B is a perspective view of an EGR mixing pipe with the interior components represented with dashed lines according to one or more embodiments of the present invention.
Figure 2:
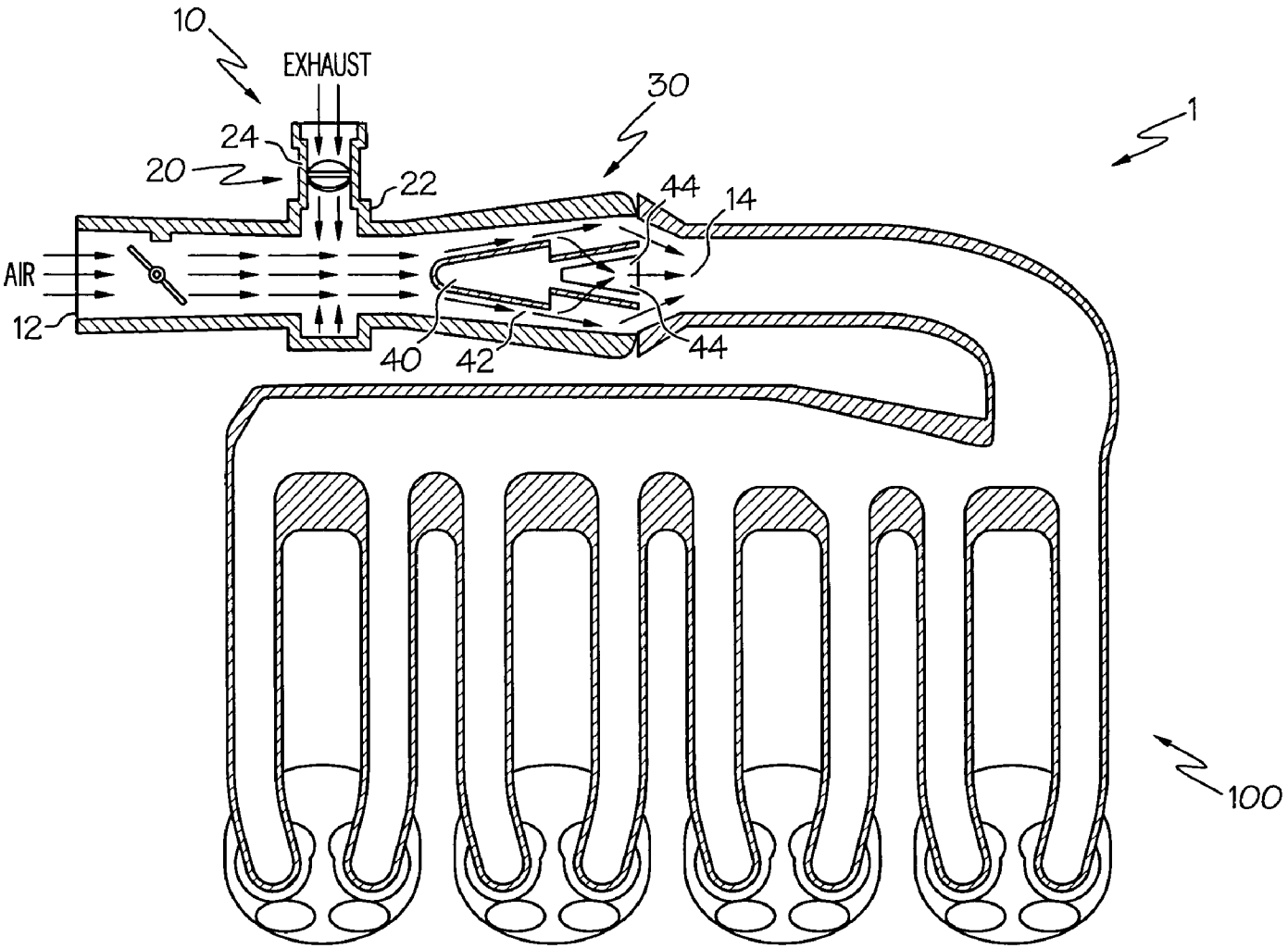
FIG. 2 is a cross-sectional view of an EGR device comprising an EGR mixing pipe and intake manifold according to one or more embodiments of the present invention.
Figure 3:
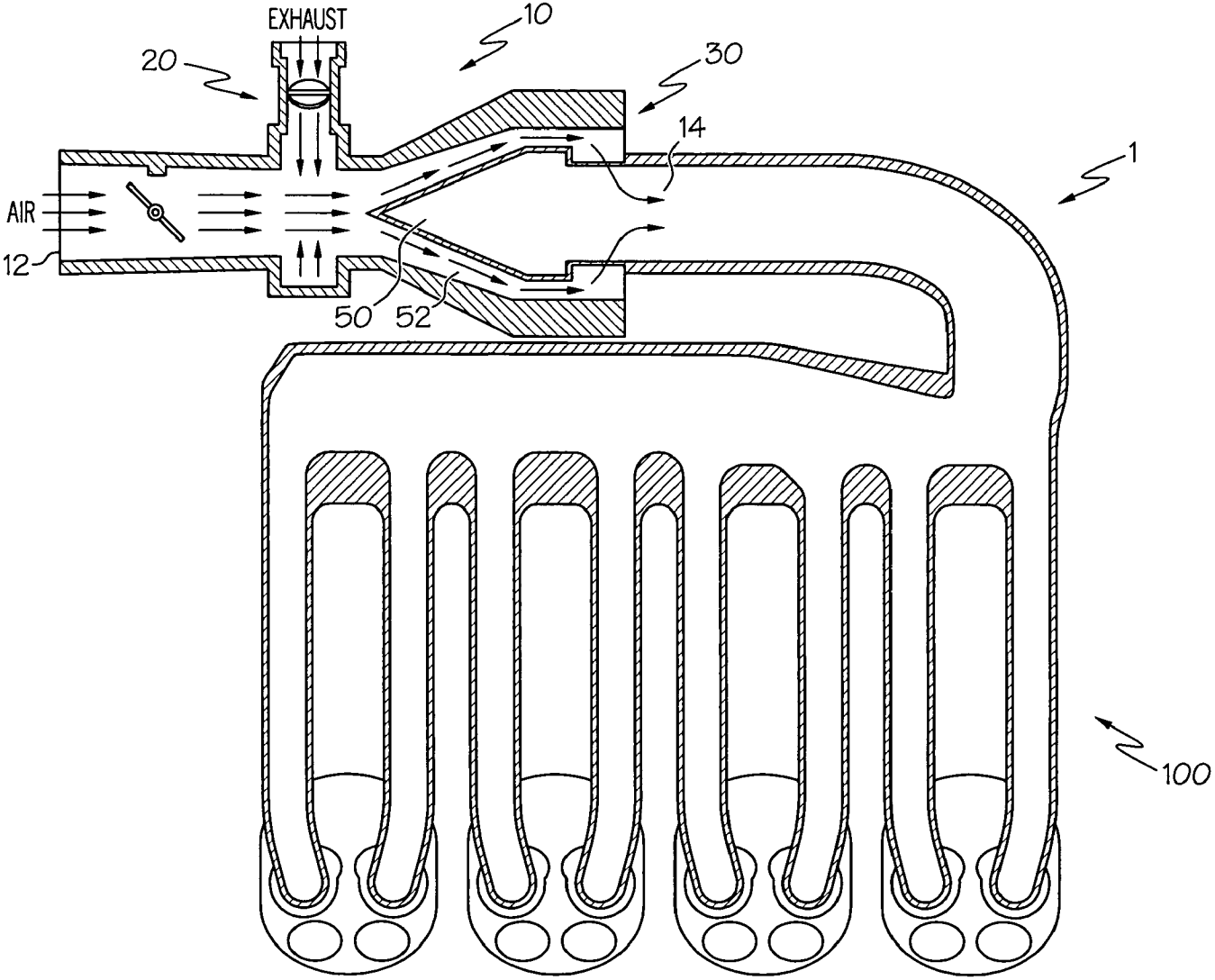
FIG. 3 is a cross-sectional view of another embodiment of an EGR device comprising an EGR mixing pipe and intake manifold.

Referring to the embodiment of FIG. 1A, the EGR device included a mixing pipe 10 having an air inlet port 12 disposed at one end of the mixing pipe 10, and an outlet port 14 disposed at an opposite end of the mixing pipe. Referring to FIGS. 2 and 3, the outlet port 14 of the device 1 is in communication with the intake manifold 100. Referring to FIG. 1, the mixing pipe 10 further includes an exhaust inlet port 20 disposed at a region of the mixing pipe 10 between the air inlet port 12 and the outlet port 14. In operation, air, which is delivered into the inlet port 12, mixes with exhaust delivered through the exhaust inlet port 20, and the air/exhaust mixture is output through the outlet port 14 of the mixing pipe 10. Referring to FIGS. 1A and 1B, the exhaust inlet port 20 may include an exhaust inlet ring 22 disposed coaxially around the mixing pipe 10 and comprising a plurality of radial openings (e.g., holes 23 or tubes 25) extending through the inlet ring 22. Additionally as shown, the exhaust inlet port 20 may also comprise an exhaust inlet tube 24 extending from the exhaust inlet ring 22. The exhaust inlet tube 24 receives exhaust (e.g., combustion exhaust) and transports the exhaust to the inlet ring 22 for subsequent delivery through the radial openings (e.g., holes 23 or tubes 25). By including a plurality of radial openings, the exhaust may contact the air at a plurality of locations upon entry into the mixing pipe 10. By contacting a greater surface area of the air feed, the radial openings will facilitate greater mixing of air and exhaust.

Figure 1C:
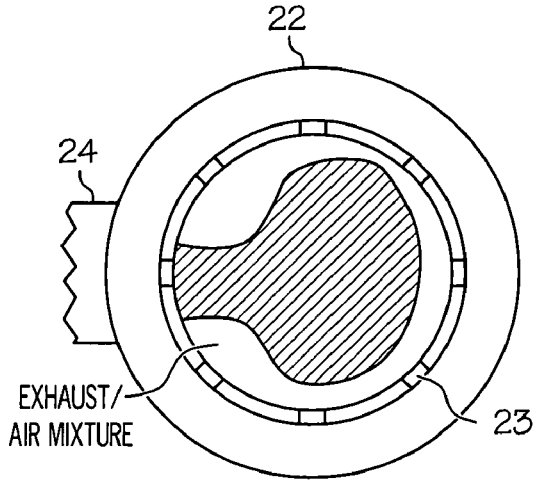
FIG. 1C is a partial view of an exhaust inlet ring having a plurality of radial holes inside the ring according to one or more embodiments of the present invention.
Figure 1D:
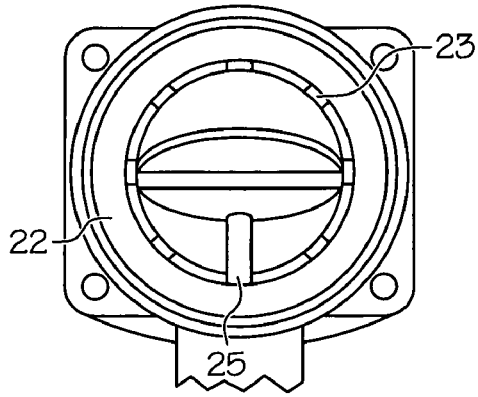
FIG. 1D is a partial view of an exhaust inlet ring having a plurality of radial holes and an inlet tube according to one or more embodiments of the present invention.
Figure 1E:
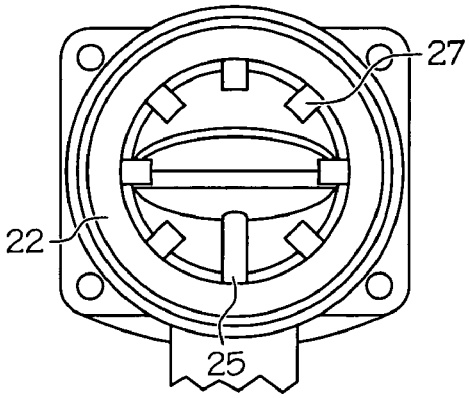
FIG. 1E is a partial view of an exhaust inlet ring having a plurality of extended radial holes and an inlet tube according to one or more embodiments of the present invention.
Figure 1F:
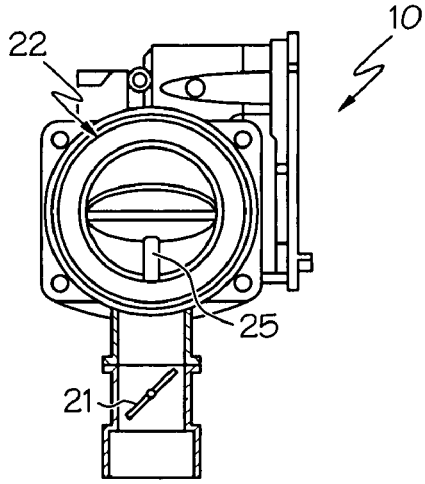
FIG. 1F is a front view exhaust inlet ring having an inlet tube according to one or more embodiments of the present invention.

Referring generally to FIGS. 1C-1E, the radial openings may comprise holes 23 as shown in FIG. 1C, at least one tube 25 as shown in FIG. 1D, or combinations thereof. In the embodiment of FIG. 1C, the exhaust is transported from the exhaust inlet tube 24 to the exhaust inlet ring 22, and is delivered to the mixing pipe through holes 23 spaced along the inner surface of the inlet ring 22. Although FIG. 1C shows the holes 23 spaced evenly apart, uneven or variable spacing of the holes 23 is contemplated herein. Furthermore, the radial openings comprise at least two radial openings with different diameters or shapes of openings. For example, one hole 23 may comprise a diameter of 2 mm, whereas an adjacent hole 23 may comprise a diameter of 5 mm. Although various sizes and shapes are contemplated, the plurality of radial openings may comprise a diameter of between about 2 mm to about 10 mm. In addition, the holes 23 may comprise varying hole depths and varying cross-sections, which may be desirable to adjust the flow rate of the exhaust.

Referring to FIGS. 1B and 1D, the inlet ring 22 may comprise radial openings configured as tubes 25 extending past the inner surface of the inlet ring 22 toward the middle of the mixing pipe 10. This can further assist exhaust delivery towards the center of the air feed, not just along the periphery of the air feed. Referring to FIG. 1E, the exhaust inlet ring 22 may comprise tubes of variable length, for example, longer inlet tubes 25 or shorter inlet tubes 27 extending slightly past the inner surface of the inlet ring 22. In the exemplary embodiment of FIG. 1D, the opening inside the inlet ring 22 may comprise a diameter of 60 mm, and the tube 25 may comprise a length of about ¼ to about ½ of the diameter (e.g. 19 mm). As shown in FIG. 1B, combinations of tubes 25 and holes 23 may also be utilized.

Referring to FIGS. 1B and 2, in addition to improved delivery of exhaust into the mixing pipe, embodiments of the present invention are also directed to increasing the mixing time within the mixing pipe 10. To increase the mixing time, the mixing pipe 10 may also comprise a diffuser nozzle 40 disposed within a region 30 of the mixing pipe between the exhaust inlet port 20 and the outlet port 14. As shown in FIGS. 2 and 3 (FIG. 3 showing an alternative embodiment of a diffuser nozzle), mixing region 30 provides additional mixing for the air/exhaust mixture prior to delivery to the intake manifold 100. As shown in FIG. 2, the diffuser nozzle 40 may comprise a cross-section which tapers outwardly in the direction of the outlet port 14 with at least one opening 44 along a portion of its length. Alternatively, as shown in FIG. 3, the EGR mixing pipe 10 may include a diffuser nozzle 50, which does not include an opening along its length. Referring to the blunt cone diffuser nozzle 40 of FIG. 2 or the sharp cone diffuser nozzle 50 of FIG. 3, the diameter of the nozzle may increase as the exhaust travels over the diffuser nozzle. For example, the diffuser nozzle may taper outwardly such that the diameter of the diffuser nozzle increases by about 2 to about 5 times.

As shown in the exemplary embodiments of FIGS. 2 and 3, the diffuser nozzle 40 or 50 may be arranged coaxially inside mixing region 30 of the mixing pipe 10. In a further embodiment, the mixing region 30 of mixing pipe 10, which surrounds the diffuser nozzle 40 or 50 may also comprise an outwardly tapering cross section. Referring to FIGS. 1B and 2, the openings 44 of diffuser nozzle 40 are configured to produce a central mixing channel extending through the diffuser nozzle 40, as well as an outer mixing channel in the spacing 42 between the diffuser nozzle 40 and surrounding region 30. Referring to FIG. 3, the closed diffuser nozzle 50 defines an outer mixing channel in the spacing 52 between the diffuser nozzle 50 and surrounding region 30.

As illustrated in FIGS. 2 and 3, splitting the exhaust/air mixture via the diffuser nozzle and utilizing the outwardly tapering cross-sections forces the air/exhaust mixture to travel a greater distance before exiting the mixing pipe 10 and entering the intake manifold 100. Consequently, the residence time of the air/exhaust mixture inside the mixing pipe 10 is increased, thereby facilitating greater mixing of the air/exhaust mixture within the mixing pipe 10. As a result, the intake manifold 100 receives a better mixed air/exhaust stream, which the manifold 100 then delivers to an internal combustion engine (not shown). As stated above, improved air/exhaust mixtures improve the performance of internal combustion engines by reducing the combustion temperature and reducing NOx production.

Figure 4A:
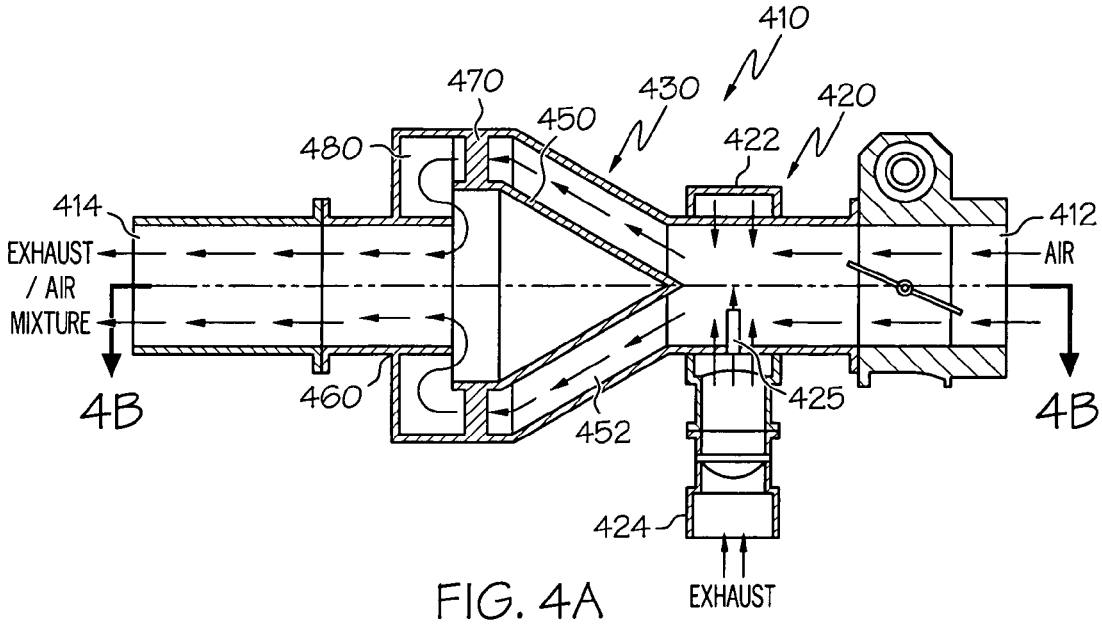
FIG. 4A is a side cross-sectional view of an EGR mixing pipe according to one or more embodiments of the present invention.

FIGS. 4A-8B illustrate several embodiments of EGR mixing pipes comprising several exemplary embodiments of diffusers/diffuser nozzles incorporated therein. For example, FIGS. 4A and 4B illustrate an EGR mixing pipe 410 having a sharp cone diffuser nozzle 450 without openings. The EGR mixing pipe 410 also comprises an air inlet port 412, an exhaust inlet port 420 comprising an exhaust inlet ring 422 and an exhaust inlet tube 424. Viewing FIGS. 4A and 4B (4B is a rotated view of FIG. 4A), the exhaust inlet ring 422 utilizes tubes 425 or radial holes 423 to deliver exhaust to the mixing pipe 410. Moreover, the mixing pipe 410 embodiments of FIGS. 4A and 4B comprise helical vanes 470 used to turn (e.g. in a helical or spiral direction) the air/exhaust mixture after the air/exhaust mixture flows over the diffuser nozzle 450. In further embodiments, an additional chamber 480 may also be used to ensure the proper flow of air/exhaust towards the outlet port 414. As shown in FIGS. 4A and 4B, this spiral or helical flow, which is caused by the helical vane 470, may increase the residence time and consequently increase the mixing of air and exhaust inside the mixing pipe 410.

Figure 4B:
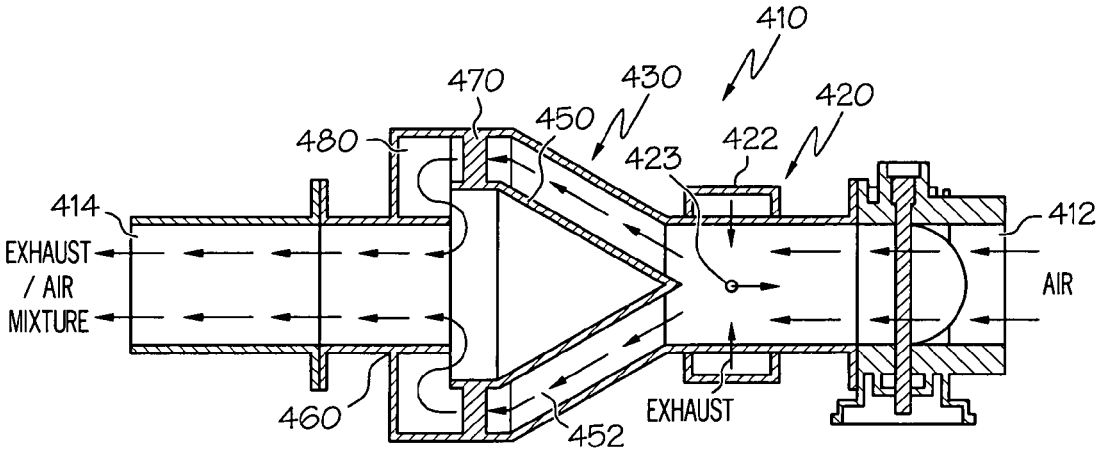
FIG. 4B is a bottom cross-sectional view of the EGR mixing pipe of FIG. 4A according to one or more embodiments of the present invention.
Figure 5A:
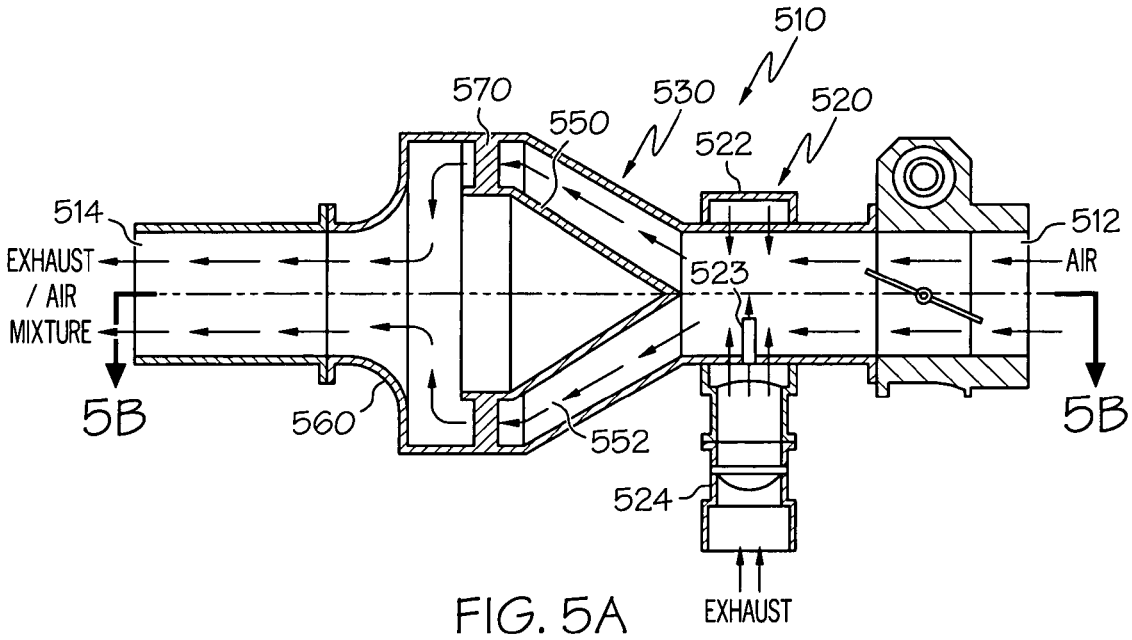
FIG. 5A is a side cross-sectional view of another embodiment of an EGR mixing pipe.
Figure 5B:
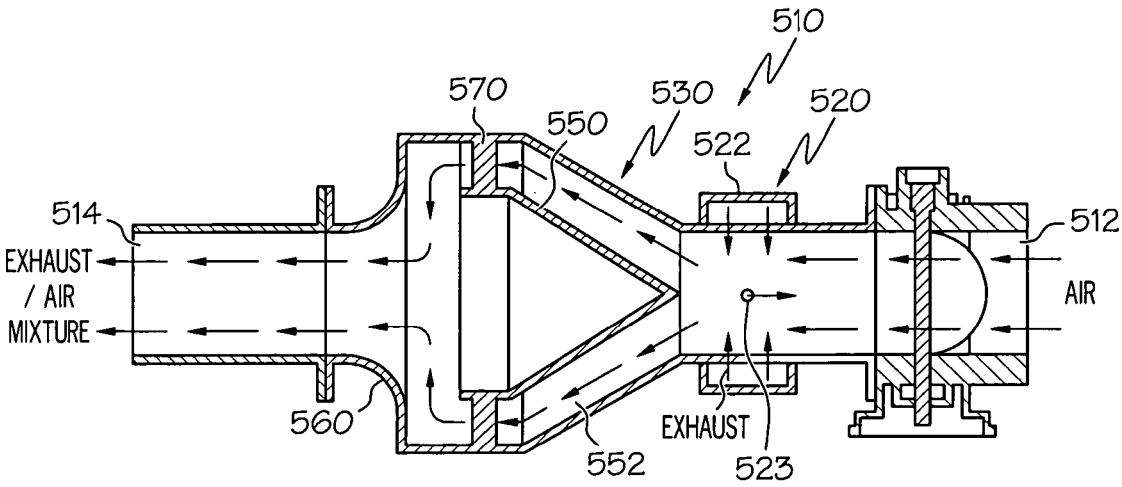
FIG. 5B is a bottom cross-sectional view of the EGR mixing pipe of FIG. 5A according to one or more embodiments of the present invention.
Figure 6A:
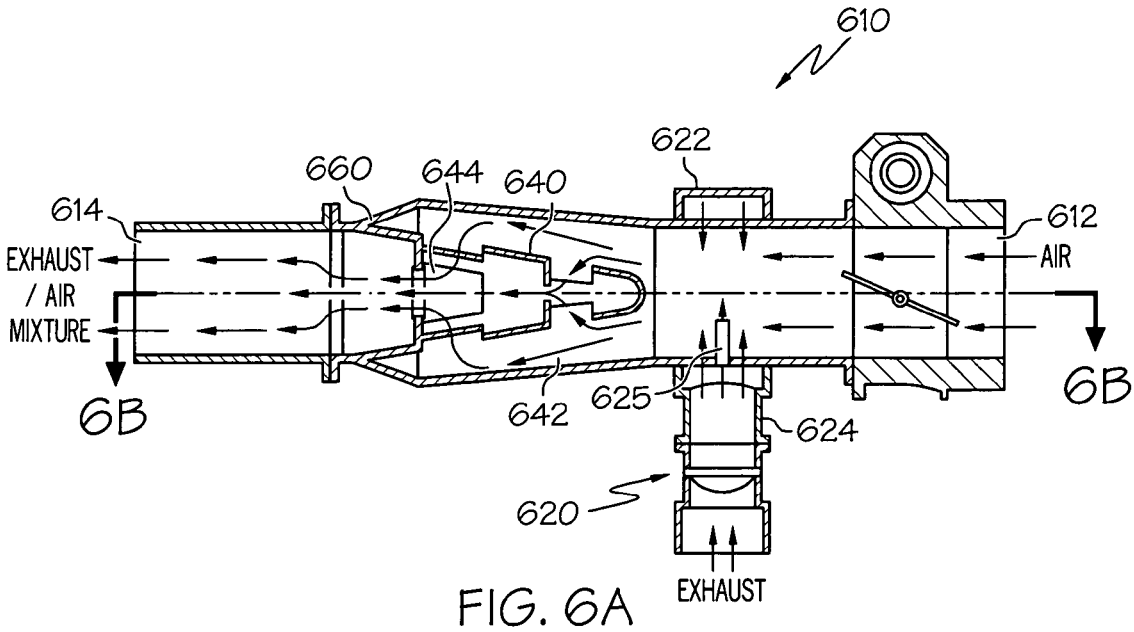
FIG. 6A is a side cross-sectional view of an embodiment of an EGR mixing pipe having a diffuser nozzle according to one or more embodiments of the present invention.
Figure 6B:
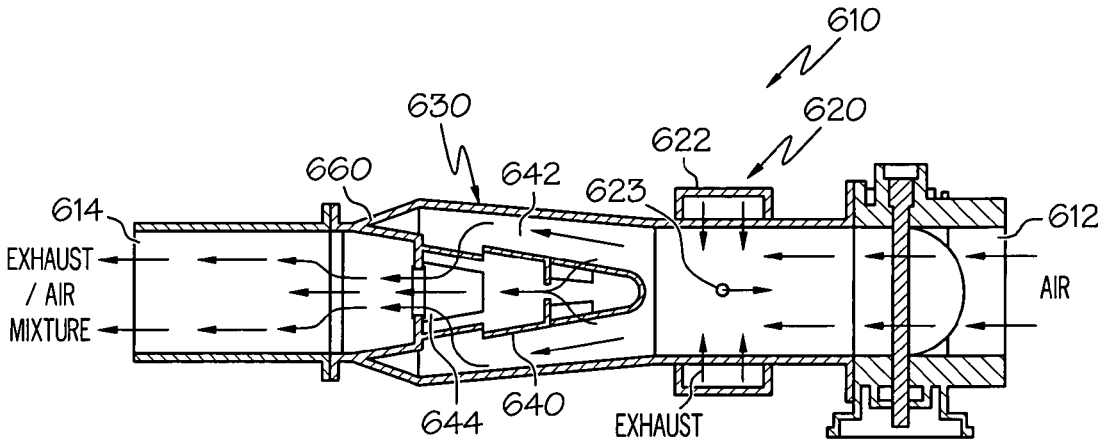
FIG. 6B is a bottom cross-sectional view of the EGR mixing pipe of FIG. 6A according to one or more embodiments of the present invention.
Figure 7A:
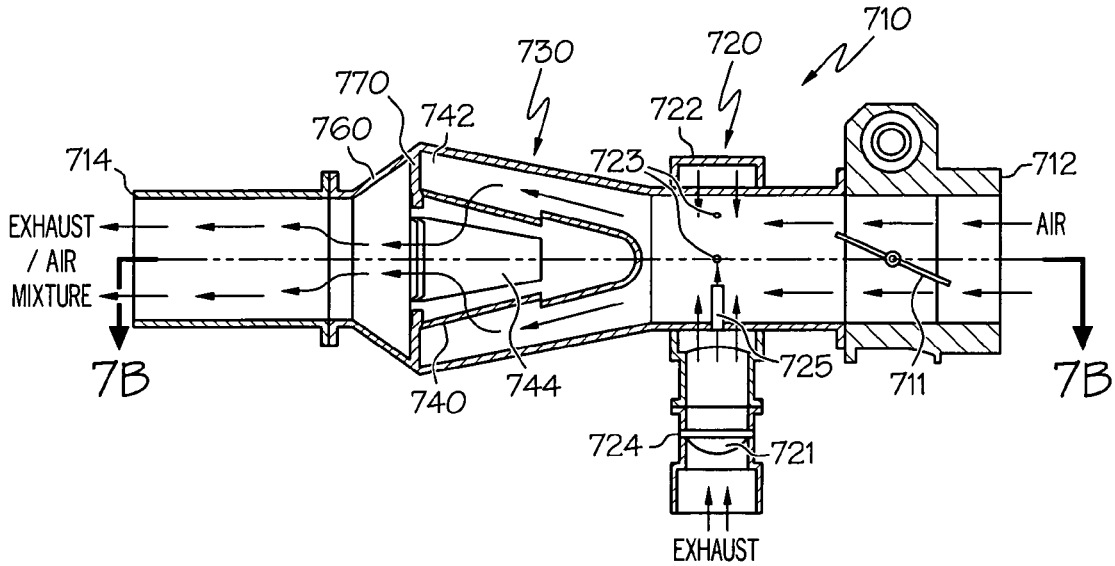
FIG. 7A is a side cross-sectional view of another embodiment of an EGR mixing pipe having a diffuser nozzle.
Figure 7B:
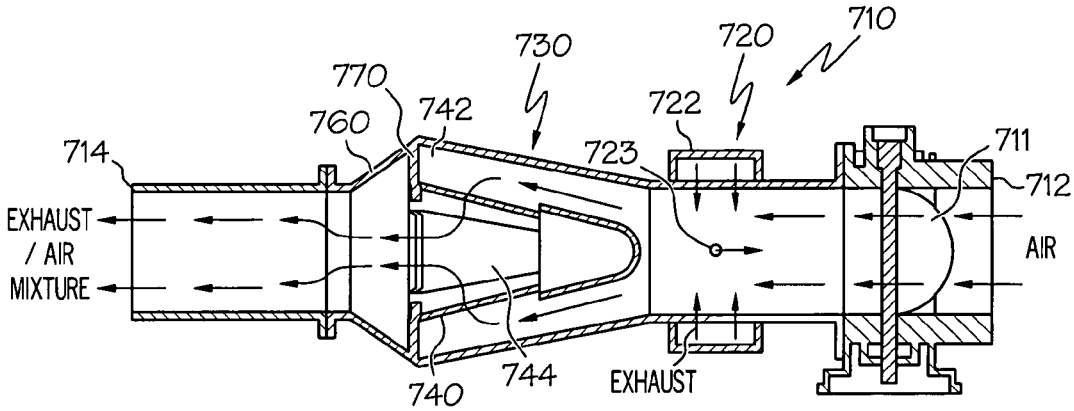
FIG. 7B is a bottom cross-sectional view of the EGR mixing pipe of FIG. 7A according to one or more embodiments of the present invention.
Figure 8A:
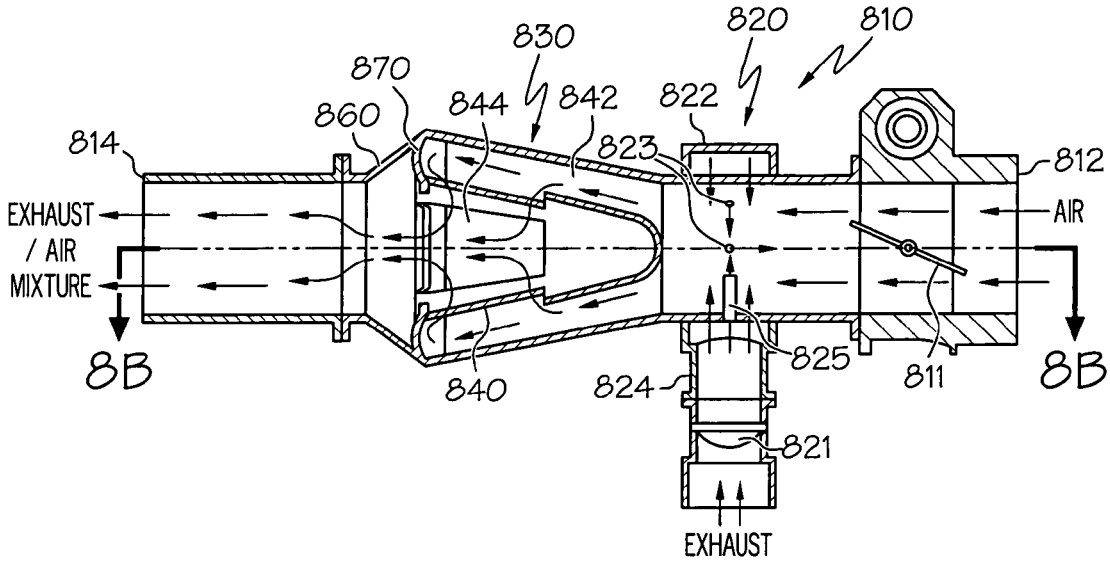
FIG. 8A is a side cross-sectional view of yet another embodiment of an EGR mixing pipe having a diffuser nozzle.
Figure 8B:
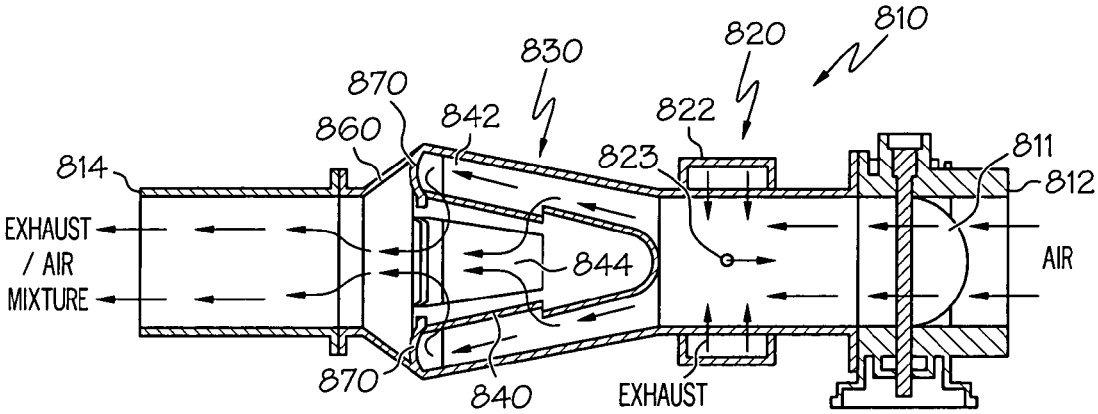
FIG. 8B is a bottom cross-sectional view of the EGR mixing pipe of FIG. 8A according to one or more embodiments of the present invention.

The embodiment illustrated in FIGS. 5A and 5B are similar to the embodiments illustrated in FIGS. 4A and 4B, respectively; however, the interfaces between the outlet ports 414 and 514 and mixing regions 430 and 530, respectively, differ. As shown in FIG. 4A, the mixing region 430 interfaces with the outlet port 414 at a substantially right angle, whereas the mixing region 530 of FIG. 5A and the outlet port 514 meet via a curved interface 560. It may be desirable to use a curved interface 560, because a curved interface 560 minimizes pressure losses of the air/exhaust mixture, as compared to the flat interface 460 of FIGS. 4A and 4B.

FIGS. 6A-8B illustrate EGR mixing pipe embodiments 610, 710, and 810 comprising diffuser nozzles 640, 740, and 840, respectively, with openings 644, 744, 844 used to form central channels within which air/exhaust mixtures may flow. By using central channels, the mixing pipes 610, 710, 810 may eliminate or minimize the need for helical vanes or additional mixing chambers as shown in FIGS. 4A and 4B. Furthermore, each EGR mixing pipe 110 includes slanted interfaces 660, 760, and 860 between respective outlet ports 614, 714, and 814, and mixing regions 630, 730, 830. The embodiments of FIGS. 6A-8B differ in how the diffuser nozzles 640, 740, and 840 couple to the pre-intake manifold mixing regions 630, 730, 830 of the mixing pipe 610, 710, and 810, respectively. Moreover, the diffuser nozzle 640, as shown in FIG. 6B has two openings which feed the central mixing channel 644. In contrast, FIGS. 7A and 8A show diffuser nozzles 710 and 810 having one opening into the central mixing channel 744, 844. Dual openings may minimize the required diameter of the diffuser nozzle, whereas single openings may minimize the required length of the diffuser nozzle and mixing pipe. It is contemplated that diffuser nozzles may comprise more than two openings into the central mixing channel. As shown in the embodiment of FIG. 8A, the diffuser nozzle 840 may also comprise helical vanes 870 used to turn the air/exhaust stream, in addition to a central mixing channel 844. Further as shown, the extension 770 of FIG. 7A defines a substantially straight cross-section, whereas the extension 870 of FIG. 8A defines a substantially curved cross-section. This may be used to minimize pressure loss.

In addition to improving the mixing of air and exhaust, the EGR mixing pipes of the present invention are also configured to increase the flow of air/exhaust mixture. As shown in FIGS. 2 and 3, it is desired that all cylinders of the intake manifold 100 receive adequate air/exhaust, thus adequate flow from the mixing pipe is desirable. As shown in FIGS. 2 and 3, by using the diffuser nozzle 40 or 50 (or the nozzles of FIGS. 4-8), the volume inside the mixing region 30 is reduced. Due to the relationship between pressure and volume, this decreased volume increases the pressure of the air/exhaust mixture leaving the mixing pipe 10, thereby providing that the air/exhaust mixture contains sufficient pressure for delivery to the cylinders of the intake manifold 100.

For the purposes of describing and defining the present invention it is noted that the terms "substantially" and "about" are utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these aspects of the invention.

What is claimed is:

1. An exhaust gas recirculation (EGR) device comprising:

a mixing pipe having an air inlet port disposed at one end of the mixing pipe;

an outlet port disposed at an opposite end of the mixing pipe;

an exhaust inlet port disposed at a region of the mixing pipe between the air inlet port and the outlet port, wherein the exhaust inlet port is configured to deliver exhaust to be mixed with air inside the mixing pipe; and a diffuser nozzle comprising an outwardly tapering cross section disposed coaxially within a region of the mixing pipe between the exhaust inlet port and the outlet port, the diffuser nozzle further comprising a closed first end adjacent a region of the mixing pipe defined by the exhaust inlet port, an open second end opposite the first end and adjacent the outlet port, and at least one opening disposed in the side of the diffuser nozzle, an outer mixing channel disposed in the spacing between the diffuser nozzle and the mixing pipe; and a central mixing channel disposed adjacent the at least one opening of the diffuser nozzle and extending through at least a portion of the diffuser nozzle.

2. The EGR mixing device of claim 1 further comprising helical vanes disposed upstream of the outlet port and configured to turn an air/exhaust mixture.

3. The EGR mixing device of claim 1 wherein the diffuser nozzle comprises multiple openings for entry into the central mixing channel.

4. The EGR mixing device of claim 1 wherein the mixing pipe region interfaces with the outlet port at a substantially right angle.

5. The EGR mixing device of claim 1 wherein the mixing pipe region interfaces with the outlet port via a curved interface.

6. The EGR mixing device of claim 1 wherein the mixing pipe region interfaces with the outlet port via a slanted extension.

7. The EGR mixing device of claim 1 wherein the mixing pipe region comprises an outwardly tapering cross section.

8. The EGR mixing device of claim 1 further comprising an exhaust inlet ring disposed coaxially around the mixing pipe at a region between the air inlet port and the outlet port, the exhaust inlet ring being comprised of a plurality of radial openings extending through the inlet ring.

9. The EGR mixing device of claim 8 wherein the radial openings comprise holes, tubes, or combinations thereof.

10. An exhaust gas recirculation (EGR) device comprising:

a mixing pipe having an air inlet port disposed at one end of the mixing pipe;

an outlet port disposed at an opposite end of the mixing pipe;

an exhaust inlet ring disposed coaxially around the mixing pipe at a region between the air inlet port and the outlet port, the exhaust inlet ring being comprised of a plurality of radial openings extending through the inlet ring, wherein the exhaust inlet ring is configured to deliver exhaust to be mixed with air inside the mixing pipe via the plurality of radial openings; and a diffuser nozzle disposed internally within a region of the mixing pipe between the exhaust inlet ring and the outlet port;

wherein the diffuser nozzle further defines a central mixing channel extending through the diffuser nozzle; and wherein the diffuser nozzle comprises multiple openings for entry into the central mixing channel.

11. The EGR mixing device of claim 10 wherein the EGR mixing pipe comprises an outer mixing channel in the spacing between the diffuser nozzle and the mixing pipe region.

12. The EGR mixing device of claim 10 further comprising helical vanes disposed upstream of the outlet port and configured to turn an air/exhaust mixture.

13. The EGR mixing device of claim 10 wherein the exhaust inlet ring comprises an exhaust inlet tube extending from the outer surface of the exhaust inlet ring and in communication with the plurality of radial openings, the inlet tube being configured to receive exhaust and deliver exhaust to the plurality of radial openings for subsequent delivery to the mixing pipe.

14. The EGR mixing device of claim 10 wherein the radial openings comprise holes, tubes, or combinations thereof.

15. The EGR mixing device of claim 14 wherein the inlet tube extends past the inner surface of the inlet ring.

16. The EGR mixing device of claim 10 wherein each radial opening is spaced a set distance from an adjacent radial opening along the inner surface of the exhaust gas inlet ring.

17. The EGR mixing device of claim 10 wherein the plurality of radial openings comprise a diameter of between about 2 mm to about 10 mm.

18. An exhaust gas recirculation (EGR) device comprising:

a mixing pipe having an air inlet port disposed at one end of the mixing pipe;

an outlet port disposed at an opposite end of the mixing pipe;

an exhaust inlet ring disposed coaxially around the mixing pipe at a region between the air inlet port and the outlet port; and a diffuser nozzle disposed coaxially within a region of the mixing pipe between the exhaust inlet port and the outlet port, wherein the mixing pipe region coaxially surrounding the diffuser nozzle defines an outwardly tapering cross section, the diffuser nozzle further comprising a closed first end adjacent a region of the mixing pipe defined by the exhaust inlet port, an open second end opposite the first end and adjacent the outlet port, and at least one opening disposed in the side of the diffuser nozzle, wherein the EGR mixing pipe comprises an outer mixing channel in the spacing between the diffuser nozzle and mixing pipe region, and a central mixing channel disposed adjacent the at least one opening of the diffuser nozzle and extending through the diffuser nozzle.

19. The EGR mixing device of claim 18 wherein the exhaust inlet ring comprises a plurality of radial openings extending through the inlet ring, wherein the exhaust inlet ring is configured to deliver exhaust to be mixed with air inside the mixing pipe via the plurality of radial openings.

* * * * *